United States Patent [19]

Kanzaka

[11] Patent Number: 4,521,943

[45] Date of Patent: Jun. 11, 1985

[54] FASTENING FOR A GARMENT

[75] Inventor: Yoshihiro Kanzaka, Nyuzen, Japan

[73] Assignee: Nippon Notion Kogyo Co., Ltd., Tokyo, Japan

[21] Appl. No.: 534,063

[22] Filed: Sep. 20, 1983

[30] Foreign Application Priority Data

Sep. 20, 1982 [JP] Japan ..... 57-142436[U]

[51] Int. Cl.[3] ..... A44B 1/42

[52] U.S. Cl. ..... 24/689; 24/101 B; 24/690; 24/698

[58] Field of Search ..... 24/689, 690, 695, 698, 24/687, 688, 671, 599, 265 A, 702, 101 B, 230.5 R; 403/232.1, 403

[56] References Cited

U.S. PATENT DOCUMENTS

| | | | |
|---|---|---|---|
| 783,807 | 2/1905 | Tuteur | 403/232.1 |
| 829,358 | 8/1906 | Weidmuller | 24/689 |
| 950,052 | 2/1910 | Morrison | 24/101 B |
| 1,486,451 | 3/1924 | Potter | 24/101 B |
| 2,697,221 | 12/1954 | Brayton | 24/698 |
| 2,731,694 | 1/1956 | Steinmetz | 24/698 |
| 2,772,464 | 12/1956 | Dovica | 24/689 |
| 2,950,516 | 8/1960 | Wood | 24/702 |
| 2,998,627 | 9/1961 | Wood | 24/689 |
| 3,305,906 | 2/1967 | Patrick | 24/698 |
| 3,908,237 | 9/1975 | Cruse | 24/689 |

FOREIGN PATENT DOCUMENTS

| | | | |
|---|---|---|---|
| 752898 | 7/1956 | United Kingdom | 24/689 |
| 821459 | 10/1959 | United Kingdom | 24/690 |
| 1241113 | 7/1971 | United Kingdom | 24/689 |

*Primary Examiner*—Victor N. Sakran

*Attorney, Agent, or Firm*—Hill, Van Santen, Steadman & Simpson

[57] ABSTRACT

A fastening for use on a garment comprises a base, and at least two flat spikes initially projecting from the base for being pierced through the garment into apertures of a hasp, and then for being deflected into a clenched condition against the hasp, there being at least two cold-pressed grooves each opening into an outer surface of the fastening and extending longitudinally thereof across a shoulder or joint between the base and a respective one of the spikes. The fastening accordingly has a greater hardness in a region around the grooves than at other regions thereof so that the fastening is resistant to bending or other deformation around the grooves when the spikes are pierced and clenched.

7 Claims, 9 Drawing Figures

FASTENING FOR A GARMENT

BACKGROUND OF THE INVENTION

1. Field of the Invention

The present invention relates to fasteners, and more particularly to a fastening for securing hooks and eyes, buttons, studs, etc. to a garment, the fastening having at least two spikes projecting from a base for being pierced through the garment and for being clenched at the underside of the garment.

2. Prior Art

As shown in FIG. 1 of the accompanying drawings, known hook and eye members 1, 2 have fastening means which comprises a flat base 3 and a pair of flat spikes 4, 4 projecting perpendicularly from the base 3 for being pierced through a garment and then for being clenched at their tip end portions, to take a hasp (not shown) at the underside of the garment. However, because of its merely flat configuration, the prior fastening tends to be easily bent or otherwise deformed around the shoulder or joint between the base 3 and the respective spike 4 when the latter is pierced and clenched, especially if the garment is made of twilled thick fabric such as denim. With this arrangement, accurate and stable attachment of the hook and eye members 1, 2 is difficult to achieve.

SUMMARY OF THE INVENTION

According to the present invention, a garment fastening comprises a base, and at least two flat spikes initially projecting from the base for being pierced through a garment into apertures of a hasp, and then for being deflected into a clenched condition against the hasp at the underside of the garment, there being at least two cold-pressed grooves each opening into an outer surface of the fastening and extending longitudinally thereof across a shoulder or joint between the base and a respective one of the spikes. The fastening hence has a greater hardness in a region around the grooves than at other regions thereof.

It is therefore an object of the invention to provide an improved fastening, for use on a garment, which is resistant to bending or other deformation around the shoulder or joint between a base and a respective spike when the latter is pierced through the garment and is then deflected to take a hasp at the underside of the garment, thus enabling easy and accurate attachment of hooks and eyes, studs, buttons, etc. to the garment.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
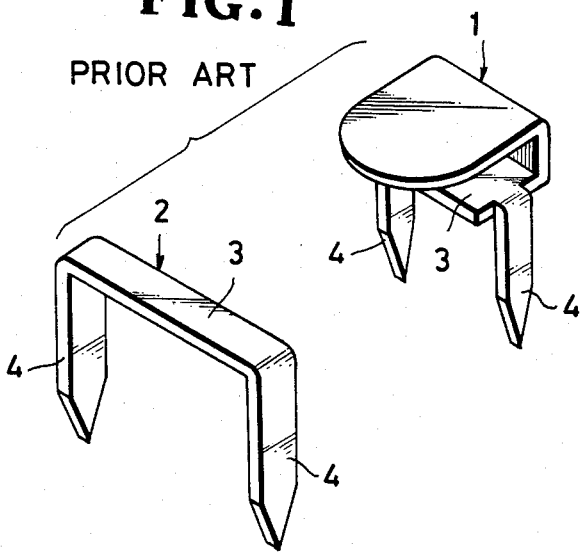
FIG. 1 PRIOR ART
FIG. 1 is a perspective view of a hook and an eye, each having a prior art fastening.
Figure 2:
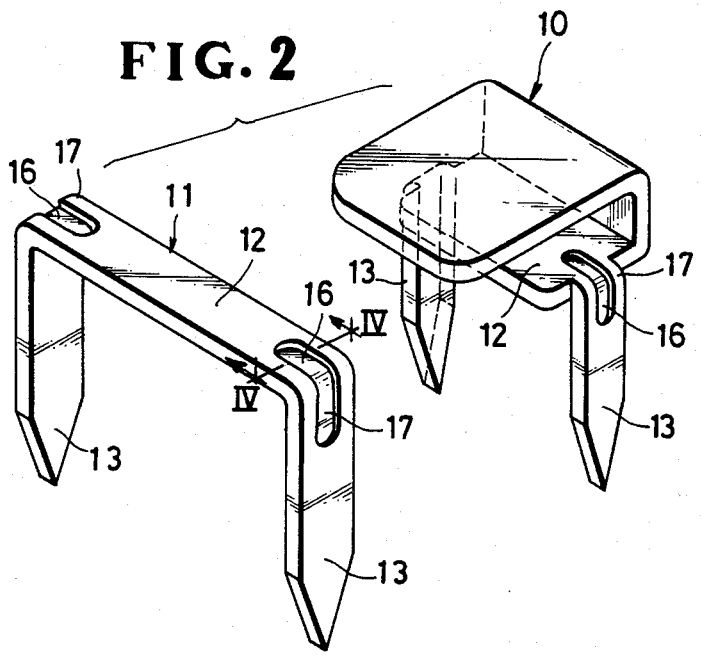
FIG. 2 is a perspective view of a hook and an eye, each having a fastening embodying the present invention.
Figure 7:
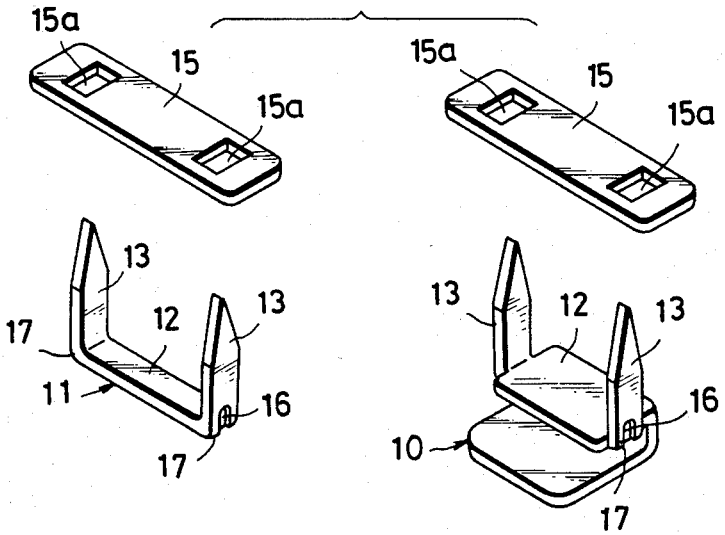
FIGS. 7, 8 and 9 are perspective views illustrating the manner in which the hook and eye are progressively assembled with their respective companion hasps.
Figure 8:
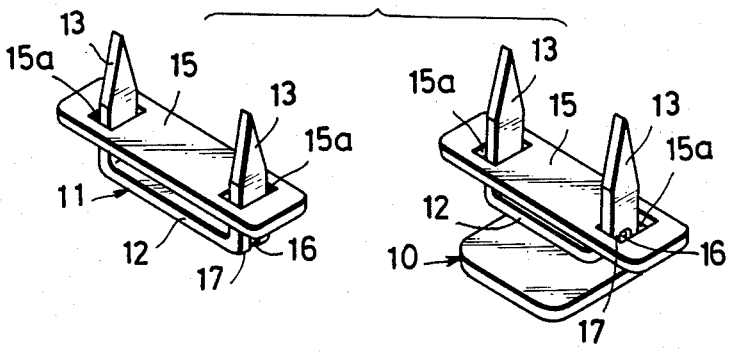
Figure 9:
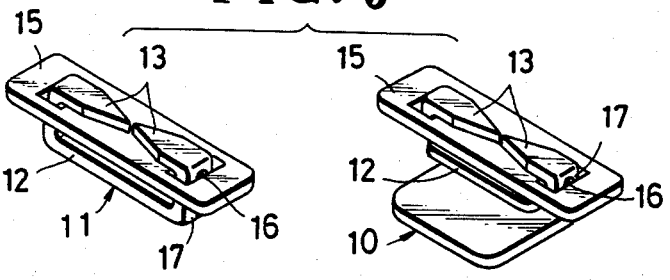

FIG. 2 shows a hook 10 and an eye 11, each having a fastening embodying the present invention. The fastening comprises a flat base 12, and a pair of flat spikes 13, 13 initially (FIGS. 2 and 7) projecting perpendicularly from the base 12 for being pierced through a garment (not shown) into a pair of apertures 15*a*, 15*a* of a hasp 15, as shown in FIG. 8, and then for being deflected into a clenched condition at their tip end portions against the hasp 15 at the underside of the garment, as shown in FIG. 9.

Figure 3:
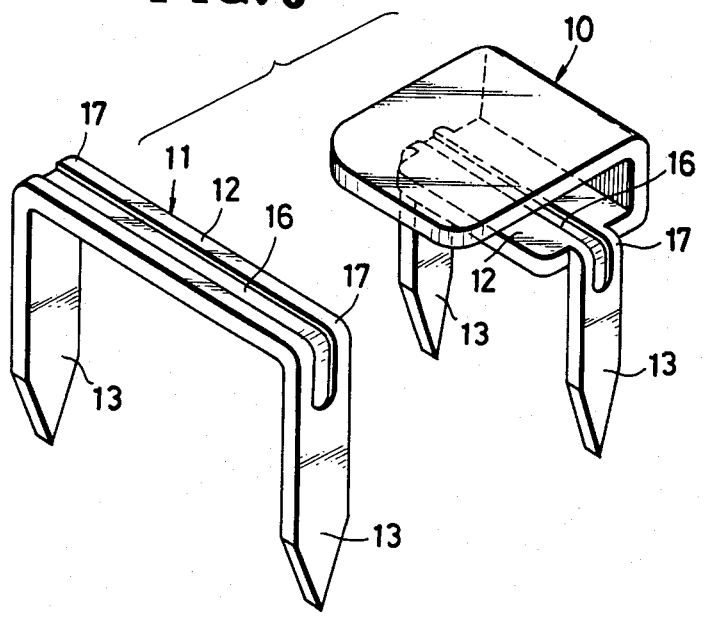
FIG. 3 is a perspective view, showing a modification of the fastening.
Figure 4:
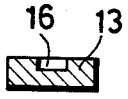
FIG. 4 is a cross-sectional view taken along line IV—IV of FIG. 2, showing a groove of rectangular cross section.
Figure 5:
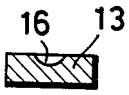
FIGS. 5 and 6 are cross-sectional views similar to FIG. 4, showing variations thereof.
Figure 6:
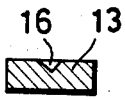

As better shown in FIG. 2, the fastening of each of the hook 10 and eye 11 has a pair of grooves 16 each opening into an outer surface of the fastening and extending longitudinally thereof across a shoulder or joint 17 between the base 12 and a respective one of the spikes 13. The grooves 16 of FIG. 2 have a rectangular cross section. Alternatively, the grooves 16 may be of a semi-circular cross section (FIG. 5) or a triangular cross section (FIG. 6). Further, the two grooves 16, 16 of one and the same fastening may be united at their confronting ends in the base 12, as shown in FIG. 3.

The fastening may be made of stainless steel, brass or other suitable metal. In production, the grooves 16 are formed by cold pressing to make the fastening harder in regions around the grooves 16 than at other regions thereof. This cold pressing not only increases the yield and tensile strength of the fastening around the grooves 16, but also reduces the ductility of the fastening around the grooves 16.

Having such cold-pressed grooves 16, the fastening is resistant to bending or other deformation at the regions around the shoulder or joint 17 between the base 12 and the respective spike 13 when the latter is forced through a garment and is then clenched to take the hasp 15 at the underside of the garment, thus enabling easy and accurate attacment of the hook 10 and eye 11 to the garment with adequate firmness even if the garment is made of twilled thick fabric such as denim.

Although various minor modifications may be suggested by those versed in the art, it should be understood that I wish to embody within the scope of the patent warranted thereon, all such embodiments as reasonably and properly come within the scope of my contribution to the art.

What is claimed is:

1. A hook and eye for use on a garment, said hook being receivable in said eye when assembled onto the garment, comprising:

(a) a pair of hasps having at least two apertures;

(b) a hook base and an eye base, each said base having at least two spikes initially projecting from said base for being pierced through the garment into the apertures of one of said hasps, and for being deflected into a clenched condition against one of said hasps; and (c) means disposed around a joint between each said base and said spikes for opposing deformation of either of said hook and eye around said joint when said spikes are pierced and clenched, each of said means comprising a cold-pressed groove opening outwardly and extending longitudinally across said joint, said hook and eye each thereby having a greater hardness in a region around said grooves than at other regions thereof.

2. A hook and eye according to claim 1, said grooves extending along the entire length of said bases.

3. A hook and eye according to claim 1, each of said grooves being composed of a pair of separate grooves each extending toward and terminating short of each others's confronting end.

4. A hook and eye according to claim 1, each of said grooves terminating far short of a tip of the respective spike.

5. A hook and eye according to claim 1, each of said grooves having a rectangular cross-section.

6. A hook and eye according to claim 1, each of said grooves having a semi-circular cross-section.

7. A hook and eye according to claim 1 each of said grooves having a triangular cross-section.

* * * * *